United States Patent [19]

Edel

[11] 3,945,733

[45] Mar. 23, 1976

[54] MECHANICAL PENCIL

[75] Inventor: Güenter Edel, Fuerth, Germany

[73] Assignee: A.W. Faber-Castell, Nurnberg, Germany

[22] Filed: Apr. 15, 1974

[21] Appl. No.: 460,906

[30] Foreign Application Priority Data

Oct. 12, 1973 Austria ..... 8725/73

[52] U.S. Cl. ..... 401/94; 401/65

[51] Int. Cl.[2] ..... B43K 21/22

[58] Field of Search ..... 401/65, 67, 92, 94

[56] References Cited

UNITED STATES PATENTS 2,319,823 5/1943 Moore ..... 401/65

FOREIGN PATENTS OR APPLICATIONS 1,103,083 5/1955 France ..... 401/94

*Primary Examiner*—Lawrence Charles

*Attorney, Agent, or Firm*—Michael J. Striker

[57] ABSTRACT

A mechanical pencil of the collet-action type is provided with a collet member formed of a pair of identically configured mating half shells guiding and clamping the lead. The half shells are maintained in fixed relation with respect to one another by means of an annulus cooperating with a conically flared portion formed at one end of the collet member, whose diameter is partially reduced corresponding to the inner diameter of the annulus, and by means of a cap at the opposite end of the collet member. The parts are assembled by first sliding one and then the other one of the two collet shells through the annulus into mating relation with one another and thereafter fitting the end cap over the end of the mating shells. All parts of the pencil are maintained in assembled relation by a compression spring.

6 Claims, 7 Drawing Figures

Fig. 1
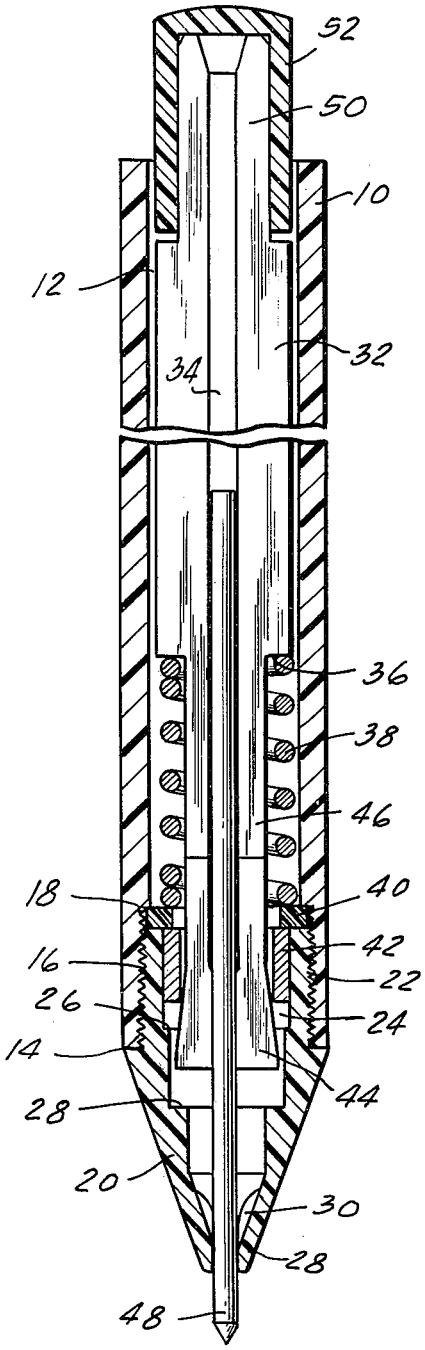
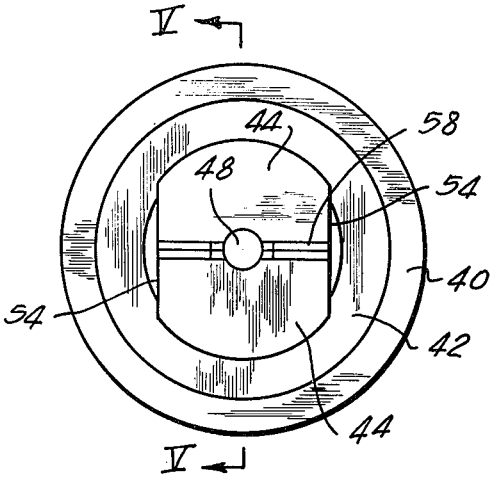
Fig. 2
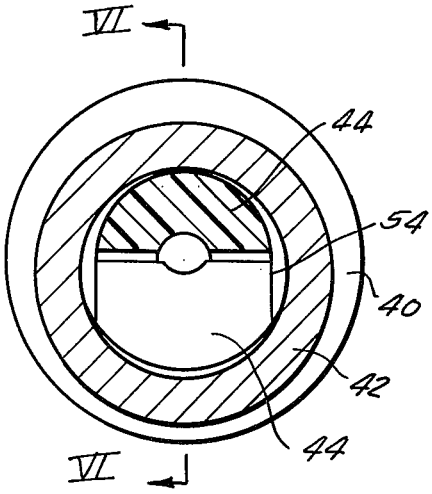
Fig. 3

Fig-4
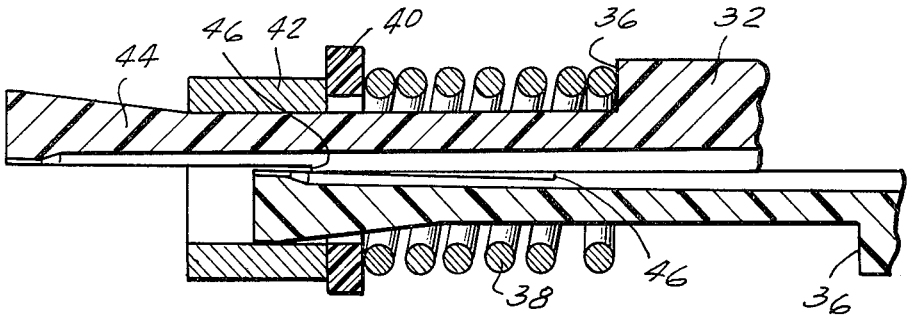
Fig-5
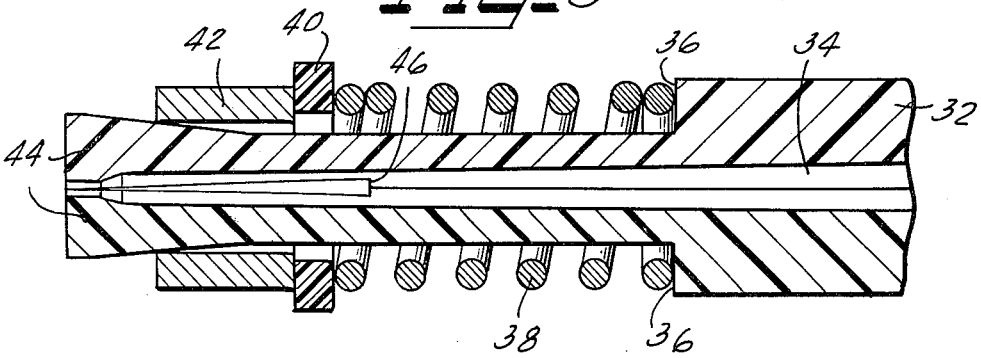
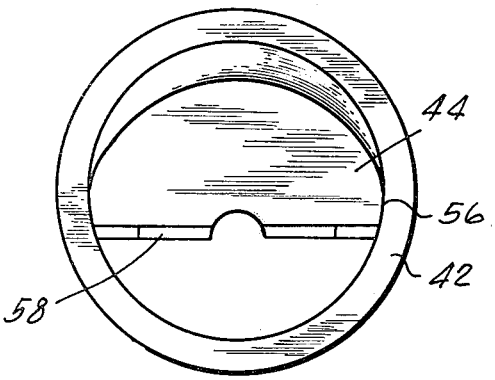
Fig-6
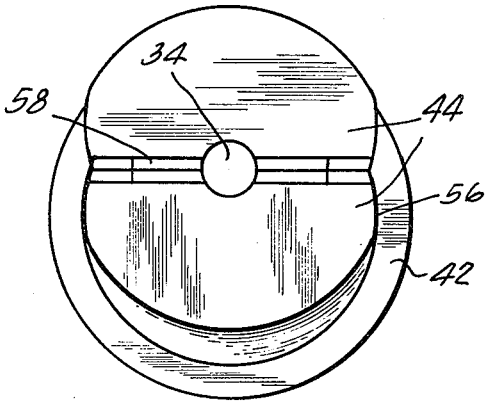
Fig-7

MECHANICAL PENCIL

BACKGROUND OF THE INVENTION

1. Field of the Invention

The present invention is directed to a mechanical pencil of the collet-action type whereby a shiftable lead is carried within a collet member and this collet member is maintained in a gripping relationship by the effect of a compression spring and is movable in opposition to the bias of the spring to advance the lead outward from the collet and, more particularly, to the design of such a collet member.

2. Prior Art

A sample embodiment of a mechanical pencil of the above type is shown in FIGS. 4 through 7 of the pending U.S. application, Ser. No. 423,476. This application describes a mechanical pencil with an outer housing having a bore formed along its axis. A collet member is formed by a pair of identically configured mating shells which are maintained in a fixed relation with respect to one another by a cap at one end thereof. The collet member is placed inside the housing bore and the cap extends beyond the housing. It can be depressed against the action of a compression spring from the outside of the housing. The depression and the simultaneous compression of the spring releases an annulus which was forced against a flared end portion of the collet member by the action of the spring, and permits the advancement of the lead. When the end cap is not depressed, the compression spring pulls the collet member into the annulus. Thereby, gripping forces are exerted onto the lead which are sufficient to oppose an individual's writing pressure.

The collet member is inserted into the annulus by axially displacing the collet halfs with respect to one another in such a way that a reduced portion of the collet member mates with the flared portion of this collet member during the insertion process. It is thereby required that both the annulus and the half shells are somewhat elastic, which makes if difficult to provide materials having the requisite sliding properties on the outside and gripping properties on the lead guiding tube side of the collet member as well as good durability of the annulus and the collet member. In addition, the assembly of two deformable members may be quite difficult. It is thus desirable to find a way of producing both the collet halfs and the annulus of non-deformable materials while permitting the placing of the flared portion of the collet member through this annulus, even though the flared portion has an essentially greater diameter than the inner diameter of the annulus.

SUMMARY OF THE INVENTION

In accordance with the present invention, the outer flared portion of each collet half has a partially reduced diameter such that most of the diameter of the outer flared portions is still larger than the boring of the annulus in a part thereof.

According to a further embodiment of the invention, a particular embodiment of this reduced diameter portion of the collet halfs permits the safe gripping of the lead, and simultaneously, prevents an inadvertent removal of the annulus under the effect of the compression spring by an exact calculation of the diameter reduction such that the collet member and the annulus have mating outlines during their assembly.

In addition, materials for the above embodiment have been tested, and, as a result, glass-fiber reinforced plastics such as polystyrene, polyamide or so-called ABS materials (acrylic butadiene styrene) have been found to be suited best for the collet member. Metals or polyacidal resins have proven to be particularly advantageous for the production of the annulus. Both of these materials can be selected in view of their strength and sliding properties as well as their surface condition. The most advantageous materials have little cold flow and great continuous strength, even if ambient temperature conditions fluctuate greatly during their use. As this has been the case in metal collet members, where a particularly springy steel has been selected, it is now possible to select a plastic material with good springy properties within a limited margin.

These and other objects, features and advantages of the present invention will be discussed in detail in the following description of the drawings, whereby variations and modifications may be effected without departing from the spirit and scope of the novel concepts of the disclosure herein.

BRIEF DESCRIPTION OF THE DRAWINGS

FIG. 1 is a longitudinal section through a complete mechanical pencil and its advance system, showing the collet member and the annulus in their assembled positions, FIG. 2 is a front view of the two half shells of the collet member and the annulus, after they have been inserted, whereby the lead 48 is in its position, FIG. 3 is a partial section through the annulus and the upper half of the collet member in its final position, while the lower half of the collet member has not yet been inserted and is axially displaced with respect to the upper half, FIG. 4 is a longitudinal section through the arrangement of FIG. 3, taken along line IV—IV of FIG. 3, FIG. 5 is a longitudinal section through an arrangement as in FIG. 2, taken along line V—V, whereby the lead had been previously removed, FIG. 6 is a front view of a particularly advantageous embodiment according to this invention, showing the annulus and the upper half shell, before its insertion into the annulus, and FIG. 7 is a front view of the annulus and both collet halfs, during the insertion of the second and lower collet half.

DESCRIPTION OF THE PREFERRED EMBODIMENTS

FIG. 1 illustrates a completely mounted mechanical lead pencil according to the invention comprising an outer housing 10 with the axial boring 12. One of the end portions 14 of the outer housing 10 has been provided with a thread 16, while forming a shoulder 18. A tip member 20 comprises a mating thread portion 22 and an axial bore 24, the diameter of which is reduced twice, while forming shoulders 26 and 28. In the portion adjacent to the exit bore 28, the bore 24 of the tip member 20 is conically reduced and provided with elastic members 30.

One half shell 32 of the collet member is placed within the outer housing 10, and it comprises an axial bore 34 serving as lead guiding tube. The outer diameter of this half shell 32 is reduced to form a shoulder 36 serving as bearing for compression spring 38. The other bearing for this compression spring 38 is formed by the mounting ring 40 which is held by the shoulder 18 of the outer housing 10 and the end portion of the tip member 20. The annulus 42 rests against the other side of this mounting ring 40 inside the axial bore 24 of the tip member 20. The collet half 32 has a conically outwardly flared end portion 44 with an outer diameter which is larger than the inner diameter of the annulus 42. A shoulder 46 formed by the collet half provides a reduced inner diameter of the lead guide tube 34 in the area forming the gripping surfaces for the lead 48. The opposite end 50 of the collet half 32 has a reduced outer diameter and serves to receive an end closure cap 52 which extends beyond the housing 10. When end closure cap 52 is depressed, spring 38 is compressed, permitting the flared end portion 44 of the collet half shell 32 to emerge from the annulus 42, thereby advancing the lead 48. The elastic members 30 maintain the lead 48 in the advanced position, while the flared outer portion 44 retracts into the annulus 42 after the release of the end closure cap 52.

FIGS. 4 and 5 show how the compression spring 38, the mounting ring 40 and the annulus 42 are plugged into the two collet halves 32 which are axially displaced with respect to one another. FIG. 3 illustrates an embodiment, whereby the diameter of the flared portion 44 has been reduced at 54 as much as required for the plugging process, while FIGS. 6 and 7 show an embodiment where the reduction 56 is designed to reduce the outer diameter of the flared portion 44 of the collet half 32 as little as possible.

The embodiment according to FIGS. 2 and 3 has proven quite satisfactory for pencils whose lead 48 is not removed. However, it may be desirable to take precautionary measures such that the pressure of the compression spring 38 can not pull the flared end 44 of the collet member 32 through the annulus 42, even when the lead 48 is removed whereby the slot 58 closes.

The embodiment according to FIGS. 6 and 7 has these advantageous properties. Here, the reduction 56 has been adapted to the shape of the annulus 42 by exact mathematical calculations, whereby the outer diameter of the flared portion has been maintained as large as possible over as great a portion of the outer circumference as possible. The maximum distance between the reduced diameter portions here corresponds exactly to the inner diameter of the annulus. This embodiment allows the easiest insertion into the annulus which is possible, while preventing that the collet member is pulled through the annulus 42 by the action of the compression spring 38.

It will be apparent from the above description of the embodiment according to this invention, that a simple, practical and effective collet member for a mechanical pencil has been provided herein which can be easily assembled and which allows the use of the best suited materials for both the collet member and the cooperating annulus, and, although there may be variations and modifications made by those skilled in the art, it is desired to include these variations and modifications within the scope of the invention as defined in the appended claims.

I claim:

1. In a mechanical pencil, a combination comprising an outer housing having an end through which a pencil lead is adapted to extend, said housing further having a stepped internal bore including a larger-diameter portion remote from and a smaller-diameter portion in said end of said housing; collet means disposed in said larger-diameter portion of said bore and consisting of two mating elongated half shells each consisting of high-strength resilient plastic material, each of said half shells having an end portion adjacent to said end of said housing and flaring outwardly toward said end, said end portions of said half shells being free of longitudinally extending slots, being separated from each other by a gap and together constituting a substantially conical end portion of said collet means; a non-deformable annulus mounted in said housing and having an internal diameter smaller than the maximum transverse dimensions of said conical end portion of said collet means, said conical end portion extending through said annulus; and compression spring means surrounding said half shells and biasing said conical end portion of said collet means in a direction away from said end of said housing and into engagement with the inner surface of said annulus, each of said outwardly flaring end portions having diametral portions spaced apart from each other by a distance which is less than said internal diameter of said annulus to allow said outwardly flaring end portions to slip through said annulus one after the other in a direction toward said end of said housing, when said half shells are axially displaced with respect to each other.

2. A mechanical pencil in accordance with claim 1, wherein said diametral portions are flats formed perpendicular to the plane separating the two mating half shells.

3. Mechanical pencil in accordance with claim 1 wherein the half shells are formed of one of the materials polystyrene, polyamide or ABS materials (acrylic, butadiene, styrene).

4. Mechanical pencil in accordance with claim 1 wherein the half shells are formed of a glass-fiber reinforced plastic material.

5. Mechanical pencil in accordance with claim 1 wherein the annulus is formed of a metal.

6. Mechanical pencil in accordance with claim 1 wherein the annulus is made of a non-deformable polyacidal resin.

* * * * *